US005669323A

United States Patent [19]

Pritchard

[11] Patent Number: 5,669,323

[45] Date of Patent: Sep. 23, 1997

[54] AUTOMATIC BAILER

[76] Inventor: Aaron L. Pritchard, R.R. 1 Box 161A, Lynch Station, Va. 24571

[21] Appl. No.: 708,942

[22] Filed: Sep. 6, 1996

[51] Int. Cl.[6] ..... F04B 49/04

[52] U.S. Cl. ..... 114/183 R; 114/347; 417/411; 417/234

[58] Field of Search ..... 114/183 R, 183 A, 114/184, 347; 417/411, 234

[56] References Cited

U.S. PATENT DOCUMENTS

| | | | |
|---|---|---|---|
| 3,941,073 | 3/1976 | Ridgeway | 114/183 R |
| 4,050,396 | 9/1977 | Ridgeway | 114/183 R |
| 4,275,995 | 6/1981 | Taylor . | |
| 4,331,883 | 5/1982 | Viteloni | 417/411 |
| 4,424,006 | 1/1984 | Armbrusten | 417/234 |
| 4,789,307 | 12/1988 | Sloan | 417/411 X |
| 5,211,363 | 5/1993 | Brown | 114/183 R |
| 5,257,590 | 11/1993 | Foote et al. | 114/347 |
| 5,493,982 | 2/1996 | Carpenter et al. | 114/347 |

*Primary Examiner*—Richard E. Gluck
*Attorney, Agent, or Firm*—Jones, Tullar & Cooper, P.C.

[57] ABSTRACT

An automatic bailer is used to remove water from an open vessel such as a whitewater canoe. The bailer utilizes a submersible pump that is connected to a power supply through flexible connections. These flexible connections allow flexural movement between the pump and the power supply which may be due to flexure of the floor of the vessel to which the bailer is securely yet removably attached or which may be a result of variations in vessel floor contours or configurations.

10 Claims, 3 Drawing Sheets

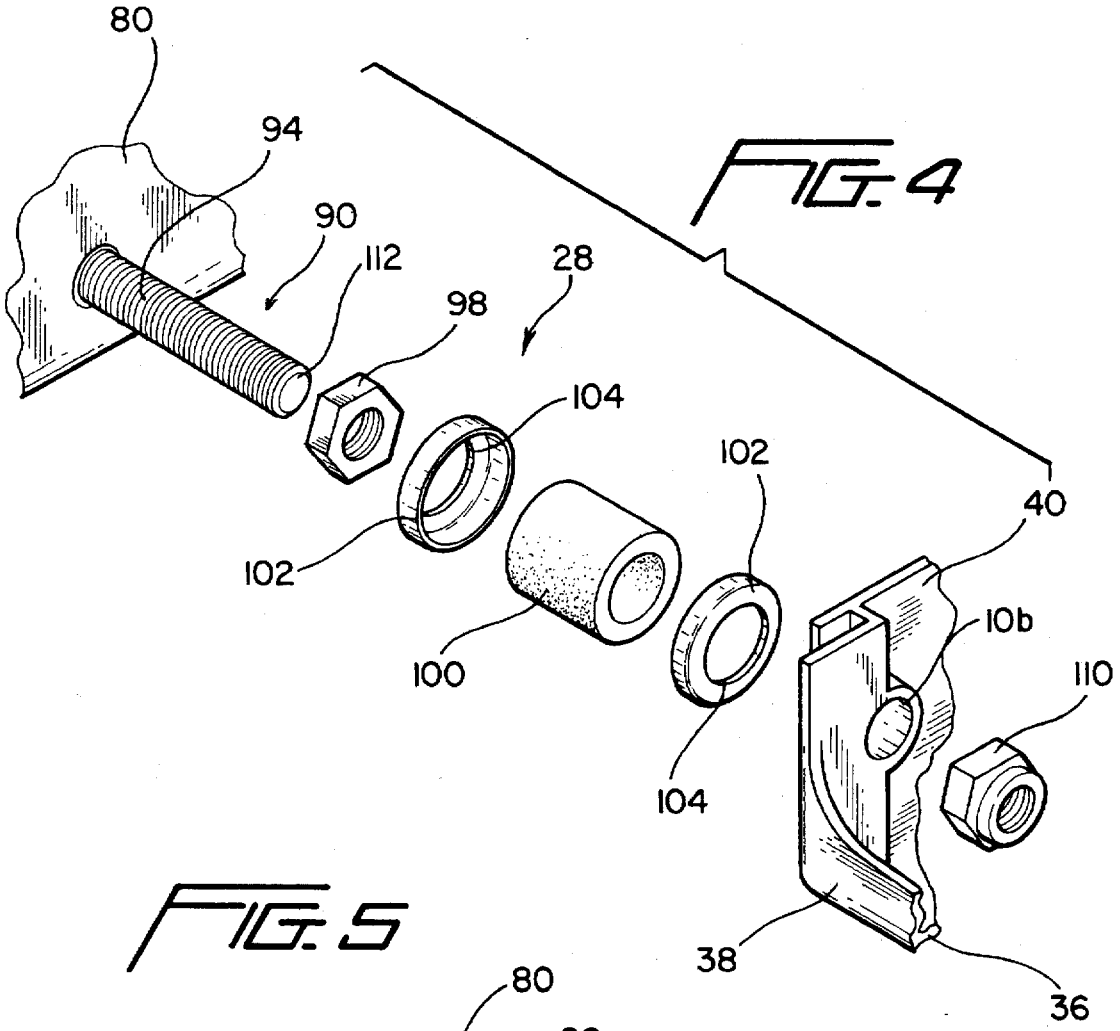
FIG. 4
FIG. 5
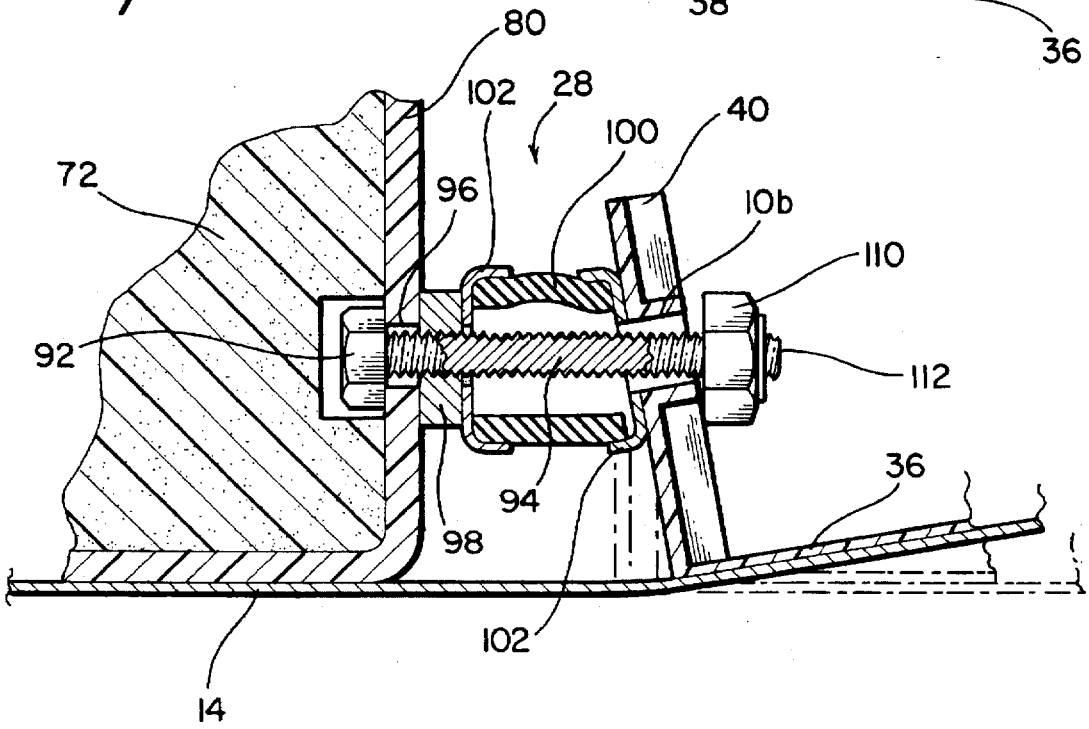

AUTOMATIC BAILER

FIELD OF THE INVENTION

The present invention is directed generally to an automatic bailer. More particularly, the present invention is directed to an automatic bailer usable to remove water from a whitewater canoe. Most specifically, the present invention is directed to an automatic bailer including an electrically operated submersible pump and a cooperating battery pack. The pump and battery are connected to each other by flexible couplings which allow flexural movement between the two. Such flexural movement between the pump and battery pack is apt to occur when the bailer is secured to the floor of a small, open boat such as a canoe that is usable in whitewater paddling. The pump is activated by a manual switch on the battery pack or by a remotely located switch.

DESCRIPTION OF THE PRIOR ART

Whitewater canoeing is a quickly growing sport that provides the participant with the opportunity to be physically and mentally challenged while spending time outside in very scenic surroundings. In the sport of whitewater canoeing, an open canoe, with typically only a single occupant, is paddled along a river which contains a variety of rapids and other turbulent areas. The canoe is typically made of aluminum, fiberglass or a similar flexible material. One or more air cells may be positionable in the canoe to improve flotation, but the canoe remains essentially open.

During the passage of the canoe through a section of whitewater, it is expected that the canoe will ship water. The amount of water which is splashed or thrown into the canoe is a function of the severity of the rapids or turbulence which comprises the whitewater, and the skill of the paddler in guiding the canoe through the rapids or turbulence. It is inevitable that some water will enter the canoe during its passage through a whitewater section.

A canoe's maneuverability is a function, to a great extent, of its weight. It is more difficult to maneuver a canoe that has taken on a large amount of water and is consequently much heavier, than one which is essentially empty. This results in a continuing need to bail the canoe. Since bailing requires the attention of the paddler, it is not possible to bail and to effectively maneuver the canoe at the same time. If the canoe becomes too filled with water, it may become necessary for the paddler to seek a quiet section or eddy so that he can bail the boat. As will be readily apparent, the manual bailing of the canoe is a necessity which detracts from the enjoyment of the sport.

Various electrically operated pump assemblies have been proposed for use in the removal of water from watercraft. The majority of these are intended for use in power craft, typically outboard powered boats, in which weight, compactness, and simplicity of operation are not primary factors. These prior art devices may utilize float switches, may be permanently secured to the floor of the vessel, or may float on the surface of the water in the vessel. None of these prior art devices are particularly suitable for use in an open, flexible, lightweight canoe where ease of operation, durability, light weight and ease of removal are all of importance. The prior art devices are not intended for use in a paddle powered, open canoe in a situation where it is important to remove a large volume of water from the canoe in a short period of time, while utilizing a construction that does not appreciably add to the weight of the canoe, that is readily attachable to, and removable from the canoe, and that is sufficiently durable to stand up to the constant cycles of submersion to which it is subjected. Most importantly, the bailer must be securable to the flexible floor of the canoe and must be able to flex to accommodate flexure of the canoe floor, as well as various canoe bottom shapes.

The prior art devices simply do not possess the desired characteristics of light weight, strength, flexibility and simplicity of operation that is required. Thus there is a need for a bailer which will provide these capabilities. The automatic bailer in accordance with the present invention overcomes the limitations of the prior art and is a significant improvement over the prior art devices.

SUMMARY OF THE INVENTION

It is an object of the present invention to provide an automatic bailer.

Another object of the present invention is to provide an electrically operated, battery powered bailer.

A further object of the present invention is to provide a bailer which utilizes a pump and a battery box.

Still another object of the present invention is to provide a bailer having a flexible coupling between the pump and the battery box.

Yet a further object of the present invention is to provide an automatic bailer which is securable to the floor of a canoe.

Even still another object of the present invention is to provide an automatic bailer that is quickly removable from the canoe.

As will be discussed in detail in the description of the preferred embodiment which is presented subsequently, the automatic bailer in accordance with the present invention includes an electrically operated, submersible pump which is connected to a power source or battery pack, in the form of a dry box, that receives a rechargeable battery. The connection between the pump and the dry box is accomplished by a flexible connection assembly that allows the pump to move or flex with respect to the battery box. Since both the pump and the battery box are situated on the floor of the open canoe, this flexible connection assembly between the pump and the dry box will accommodate for the flexation of the canoe's floor or for various floor profiles without harming the automatic bailer, and will thus allow the bailer to conform to the bottom contours of a variety of vessels.

The dry box, which holds the battery, is provided with a web strap that functions both as a carrying handle for the bailer and also as a securement arrangement that allows the secure but readily removable attachment of the bailer to the canoe floor. Since the typical sport canoe is transported in an inverted position on the roof of the owner's vehicle, it is advantageous that the entire bailer can be quickly secured in place for use and as quickly removed from the canoe when the canoe is to be transported or stored.

The automatic bailer of the present invention is preferably manually operated by the paddler through the provision of a simple rocker switch that is either positioned on the dry box which holds the battery, or which may be attachable to a thwart or a cross brace of the canoe. The use of such a manual switch keeps the bailer simple and allows the paddler to turn the pump on when the canoe has shipped water, and to turn the pump off when the canoe has been bailed out.

The automatic bailer in accordance with the present invention is effective in removing a large volume of water from an open canoe or a similar vessel in a short period of time. The bailer is durable and will not break when secured to the flexible bottom of the canoe. It is light weight, easily secured to and removed from the floor of the canoe, and easily transported. Its individual components are commercially available and low cost. Thus it satisfies the needs of the whitewater canoeist for simplicity, durability, reliability and performance. The automatic bailer in accordance with the present invention is far superior to the presently available devices and is a substantial improvement in the art.

BRIEF DESCRIPTION OF THE DRAWINGS

While the novel features of the automatic bailer in accordance with the present invention are set forth with particularity in the appended claims, a full and complete understanding of the present invention may be had by referring to the detailed description of the preferred embodiment which is presented subsequently, and as illustrated in the accompanying drawings, in which:

FIG. 4 is an exploded perspective view of the flexible connection assembly between the battery box and the pump bracket; and FIG. 5 is a cross-sectional view through the connection assembly showing the canoe floor in a flexed position.

DETAILED DESCRIPTION OF THE PREFERRED EMBODIMENT

Figure 1A:
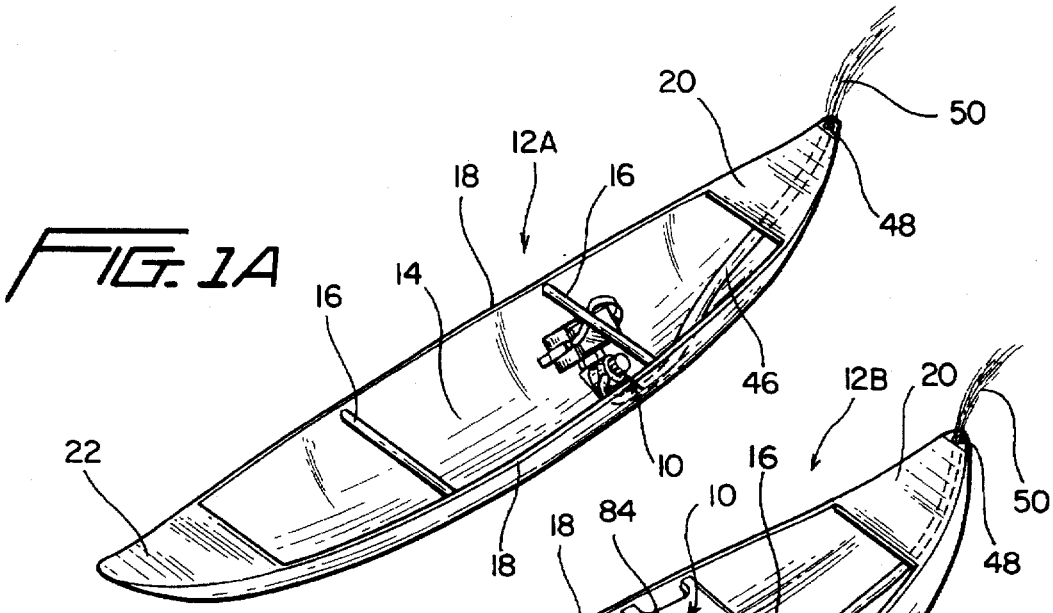
FIG. 1A is a top perspective view of an open, solo whitewater canoe and showing the automatic bailer in accordance with the present invention secured to the floor of the canoe in a transverse orientation.
Figure 1B:
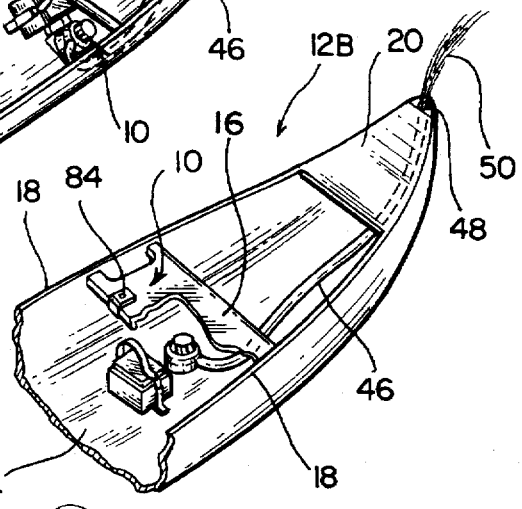
FIG. 1B is a top perspective view of a portion of a tandem, flatwater canoe and showing the bailer secured to the floor of the canoe in a longitudinal orientation.

Referring initially to FIGS. 1A and 1B, there may be seen, generally at 10 a preferred embodiment of an automatic bailer in accordance with the present invention. Automatic bailer 10 is shown in both FIGS. 1A and 1B installed in its operational position in an open canoe, generally at 12A or 12B, respectively. Each canoe 12A or 12B is intended to be illustrative of a number of open boats in which the automatic bailer 10 is intended for use. Canoe 12A is intended to depict a solo, whitewater canoe while canoe 12B is intended to depict a tandem, flatwater canoe. In the whitewater canoe, the bailer 10 is shown in a transverse position whereas in canoe 12B the bailer 10 is shown in a longitudinal position. Both positions are appropriate and are interchangeable. Each open canoe 12 has a floor 14, one or more cross braces or thwarts 16, which extend between the gunwalls 18, as well as bow and stern plates 20 and 22, respectively. It will be understood that each open canoe 12 could be provided with various inflatable flotation cells or other accessories, at the discretion of the person using it and that each canoe 12, and particularly solo whitewater canoe 12A is intended to be paddled through various types of whitewater such as the rapids and other areas of turbulence which are typically encountered along various rivers. As is readily appreciated by whitewater paddlers, the passage of canoe 12, or other similar types of open vessels, including inflatable rafts, through such sections of whitewater, inevitably results in the accumulation of water in the canoe or other craft 12. It is the purpose of the automatic bailer 12, in accordance with the present invention, to quickly remove this water from canoe 12 so that the maneuverability of the canoe 12 will not be impaired by the excess weight created by the accumulated water in the canoe.

Figure 2:
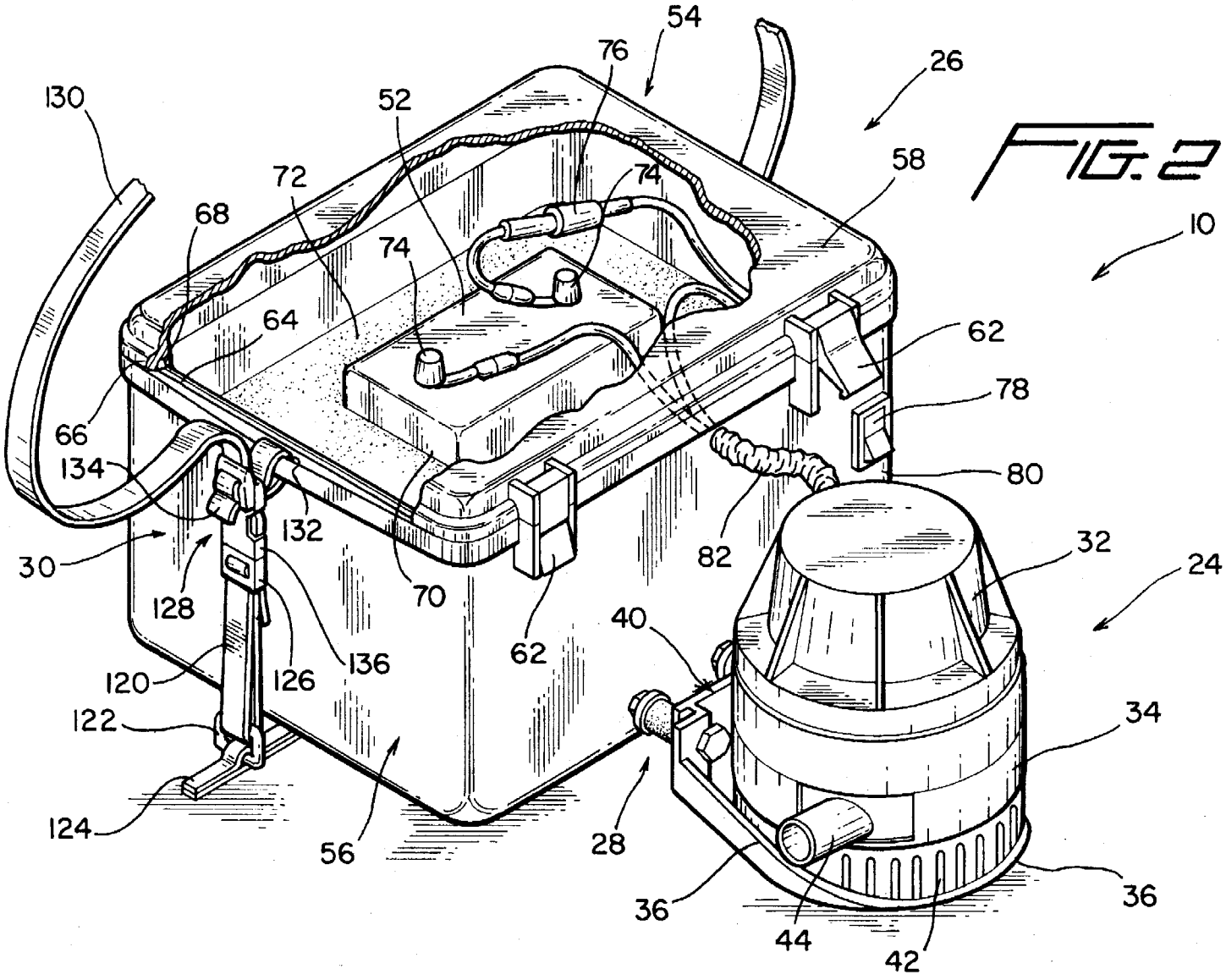
FIG. 2 is a perspective view of the automatic bailer with a portion of the dry box cover shown in cut away.

Referring now to FIG. 2, automatic bailer 10 is comprised generally of a pump 24, a power supply 26 for the pump 24, and a flexible connection assembly 28 between the pump 24 and the power supply 26. The automatic bailer 10 can be installed in canoe 12 in a transverse orientation, as depicted in FIG. 1A, or in a longitudinal orientation, as depicted in FIG. 1B. A hold down and carry handle 30 is also provided and, as will be discussed in detail subsequently, is used to secure the automatic bailer 10 to the floor 14 of the canoe 12 and to carry the automatic bailer 10 when it is not positioned in the canoe 12.

Figure 3:
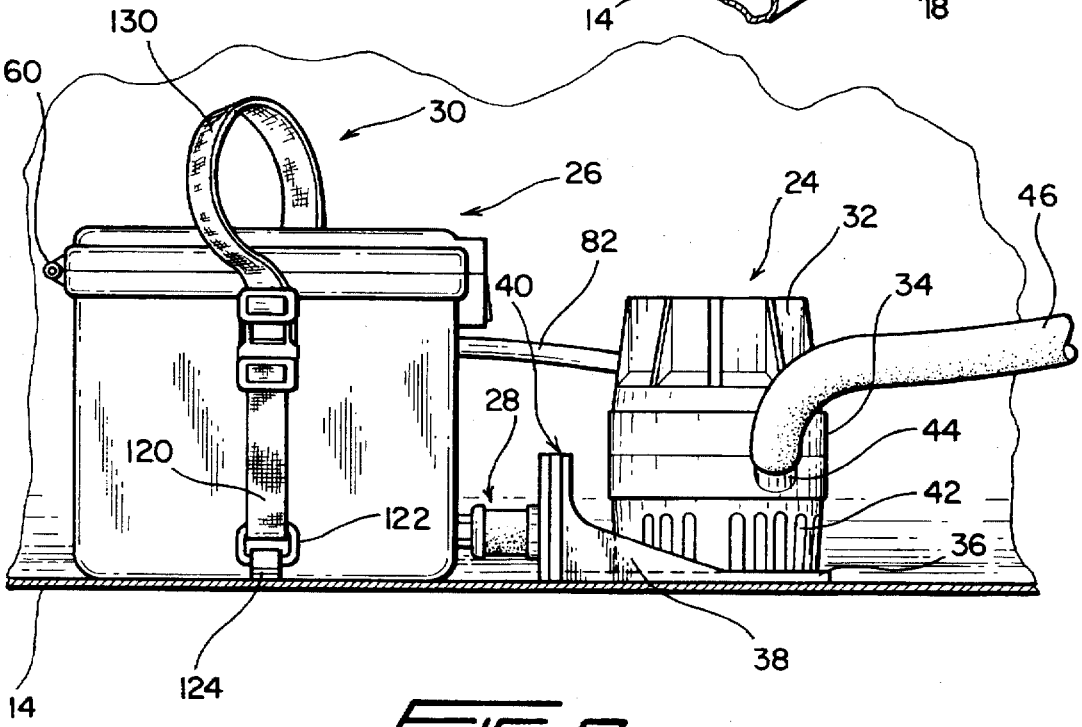
FIG. 3 is a side elevation view of the automatic bailer.

Pump 24 is a generally conventional, electrically powered, submersible pump. In the preferred embodiment, pump 24 is an Atwood 1250 pump which includes an electric motor 32 and an impeller section 34. The pump 24 is completely submersible and is mounted on a generally planar support bracket 36 that has a surrounding lip 38 and an upstanding flange 40. The pump impeller 34 is driven by the electric motor 32 and pulls water in through a plurality of intake slots 42. The water is discharged through an outlet 44. As may be seen in FIGS. 1 and 3, pump outlet 44 is connectable to a flexible discharge hose 46 that is preferably routed along the floor 14 of the canoe 12 to a discharge end 48 which is secured to the bow plate 20. In this way, the person paddling the canoe can visually ascertain that the pump is working by observing the stream of water 50 exiting the discharge end 48 of the discharge hose 46.

Referring again to FIG. 2, the pump 24, as indicated above, is electrically operated, and receives electric power from the power supply 26. In the preferred embodiment, the power supply 26 is in the form of a battery 52 which is held in a dry box, generally at 54. The purpose of dry box 54 is to protect the battery 52 and to also serve as a mount or support for the submersible pump 24. The dry box or battery box, generally at 54, is a molded plastic assembly which includes a body 56 and a lid 58. The box body 56 is a one-piece element and the lid 58 is attached to the body 56 by suitable hinges 60, as may be seen in FIG. 2. A pair of over center latches 62 are carried by the lid 58 and clamp the lid tightly in place against a box rim 64 of the box. The cover 58 has a corresponding cover rim 66 and an interposed seal 68 prevents any water from entering the dry box 54 when the lid is clamped down by the latches 62. A suitable dry box is available from Underwater Kinetics.

Battery 52, which in the preferred embodiment is a 12V, 7.0 AH, sealed cell, rechargeable battery, is positioned in the box body 56 in a recess 70 formed in a suitable closed cell foam or other similar buoyant and shock protective packing 72. The two battery terminals 74 are wired through a 3A fuse 76 to a manual rocker switch 78 which is placed on a wall 80 of the battery box body 56. The battery 52 is connected from the rocker switch 78 to the pump motor 32 through a suitable waterproof conduit 82 which extends between the box wall 80 and the pump motor 32. It will be understood that suitable waterproof seals are provided in the battery box wall 80 to prevent water from entering the interior of the box 54 around either the wiring conduit 82 or the rocker switch 78 in the event that the dry box 54 becomes completely submerged. In an alternative configuration, as may be seen in FIG. 1B, the switch for the automatic bailer may be situated at a point remote from the battery box 54. If desired, a suitable remote switch 84 can be releasably attached to the cross brace or thwart 16. Such an alternate location is at the discretion of the paddler who may find it advantageous to have the switch located in this higher position where it may be more accessible.

The pump 24 and the power supply 26 are joined by the flexible connection assembly, generally at 28 in accordance with the present invention. This flexible connection assembly 28 may be seen most clearly by referring to FIGS. 4 and 5. It is the purpose of the connection 28 to accommodate relative movement between the pump 24 and the power supply 26. This relative movement between the two components of the automatic bailer may be a result of the flexation of the floor 14 of the canoe 12 or other craft which will inevitably occur given the flexibility of the materials used in the construction of the canoe 12 and the rough usage which it encounters during passage of the canoe 12 or other vessel through the whitewater sections that are sought out by the canoe's owner. The relative movement or flexure may also be the result of different floor configurations or slopes. The flexible connector 28 accommodates such flexure between the pump 24 and the power supply 26.

As may be seen in FIGS. 4 and 5, a threaded connection bolt 90 extends between the battery box body 56 and the pump bracket flange 40. The bolt 90 has a head 92 which is located within the battery box body 56. A threaded shank 94 of bolt 90 passes through an aperture 96 in the dry box wall 80. A jam nut 98 is threaded onto bolt shank 94 and is tightened down against an outer surface of the battery box wall 80, as may be seen in FIG. 5. Intermediate the jam nut 90 and the pump bracket flange 40, the connection bolt 90 is provided with a flexible sleeve 100 and with two cup-shaped washers 102. As may be seen in FIG. 5, the inner diameter of the flexible sleeve 100 is sufficiently larger than the outer diameter of the shank 94 of the connector bolt 90 so that the flexible sleeve 100 will flex when the pump bracket 40 is moved with respect to the battery box 54. In a similar manner, the two cup-shaped washers 102, which are oriented with their cup-shaped portions facing the flexible sleeve 100 which they thereby effectively sandwich, also have central apertures 104 which are sufficiently larger than the outer diameter of the connection bolt shank 94 to facilitate movement of the pump bracket 36 with respect to the battery box 56. The cup-shaped washer 102 adjacent the battery box 56 abuts against the box wall 80. The cup-shaped washer 102 adjacent the pump 24 abuts the flange 40 of the pump support bracket 36. The flexible sleeve 100 may be made of rubber tubing or of a similar resilient material.

A through bore 106 is formed in the upstanding flange 40 of the pump support bracket 36. This flange through bore 100 is also of a suitable larger diameter with respect to bolt shank 94 to allow pump bracket 36 to move or flex with respect to the battery box wall 80, as is depicted most clearly in FIG. 5. A suitable lock nut 110 is threaded onto the free end 112 of the bolt shank 94 once this free end 112 has been inserted through the pump bracket flange through bore 106. This lock bolt 110 completes the flexible connection assembly generally at 28. It will be understood that, as may be seen in FIG. 2, two such flexible connection assemblies 28 are employed between the pump bracket flange 40 and the power supply 26. It will also be understood that these flexible connection assemblies 28 allow the pump 24 to move in all directions with respect to the power supply 26, not merely in the upward direction depicted in FIG. 5. Thus these flexible connections 28 will accommodate a wide range of movement between the pump 24 and the power supply 26 so that the two can be joined together in a fashion that will accept relative movement between the two with no damage or breakage.

As may be seen by again referring to FIGS. 2 and 3, the automatic bailer 10 in accordance with the present invention is provided with a hold down and carry handle, generally at 30. As discussed previously, it is important to be able to securely situate the automatic bailer 10 in the canoe 12 during usage of the canoe 12 while still allowing easy and quick removal of the automatic bailer 10 when the canoe 12 is to be transported or stored. A pair of securement or hold down loops or straps 120, which are each in the form of a loop of webbing are passed through suitable D-rings 122 which may be secured to the floor 14 of the canoe 12 by adhesive strips 124. Alternatively, these D-rings 122 may be attached to the floor 14 by other suitable means. Each of the securement or hold down straps or loops 120 carries a first half, such as the male half 126 of a two piece, molded snap buckle, generally at 128. The hold down strap 120 passes through the D-ring 122 and through the snap buckle half 126 and its length is adjustable in a known manner. It will be understood that the two hold down straps 120 are spaced apart by generally the width or length of the dry box 54 which provides the power supply 26 for the pump 24.

As may be seen most clearly in FIG. 2, a carry strap 130 is formed from a single thickness of the same woven webbing which is used for each of the hold down straps 120. The carry strap passes through a suitable elongated slot 132 in box rim 64 and an end 134 of carry strap 130 is fed through a second or female half 136 of the snap buckle, generally at 128. The length of the carry strap 130 is adjustable by being passed through the second half 136 of the snap buckle 128 in a generally conventional manner. It will again be understood that the carry strap 130 is secured to the dry box 54 at both ends of the box and thereby forms a carry strap for the automatic bailer. The automatic bailer 10 can thus be quickly secured in place in the canoe 12 by engagement of the two carry handle snap buckle components 136 with their corresponding securement strap snap buckle components 126. The bailer 10 is easily removed by disengagement of the buckle components 126 and 136 so that the bailer 10 can be removed and carried by the carry strap 130.

In use, the rechargeable battery 52 will be provided with a full charge by use of a suitable charging device, and the dry box lid 58 will be closed and latched in place by the over center latches 62 once the battery 52 has been placed in recess 70 in packing 72. Since the battery 52 is securely held in the dry box 56 by the resilient packing 72, it cannot shift or move and thus will not be damaged. The automatic bailer 10 is transported to the canoe 12 by its carry strap 130 and is secured in the canoe 12 by the securement straps 120. An infeed end of the discharge hose 46, which may remain in the canoe 12, is slid over the pump outlet 44. Alternatively, the discharge hose 46 may be removed from the canoe 12 and reinstalled with the bailer 10. Typically, the discharge hose 46, since it is light-weight, will be left in the canoe and its pump end will simply be slipped over the pump discharge outlet 44. The bailer 10 is now in place and ready for use. As soon as the canoe 12 has taken on an amount of water sufficient to hinder its maneuverability, the paddler of the canoe will turn the pump on by actuating the rocker switch 78 located on the dry box wall 80. Alternatively, the paddler can turn the pump on by actuating the remote switch 84, if this switch has been provided. The pump 24 will operate in a conventional manner by taking in water through the pump impeller intake slots 42 and by discharging the water through the pump outlet 44, with this water traveling through the discharge hose 46 and exiting through the hose discharge end 48. The pump will continue to be operated until no stream of water 50 is evident at the hose discharge end 48. When the paddler observes the cessation of the water stream 50, he will then turn the pump off. The canoe 12 will now be essentially emptied of any water that had been shipped and will be ready for the next section of whitewater. Once the day's canoeing activities have come to a close, the automatic bailer 10 is easily removed from the canoe by operation of the snap buckles 128 and is carried away from the canoe by the carry strap 130. The dry box lid 58 can then be opened and the battery 52 can be recharged so that the automatic bailer 10 will be ready for use again.

While a preferred embodiment of an automatic bailer in accordance with the present invention has been set forth fully and completely hereinabove, it will be apparent to one of skill in the art that a number of changes in, for example, the type of pump and dry box used, the type of battery used, the type of webbing material and the like could be made without departing from the true spirit and scope of the present invention which is accordingly to be limited only by the following claims.

What is claimed is:

1. An automatic bailer positionable in an open vessel, such as a whitewater canoe comprising:

a submersible, electrically operated pump having an inlet and an outlet;

a power supply including a battery in a dry box, said power supply being in switched electrical connection with said pump;

a flexible connection assembly joining said pump to said dry box to allow movement of said pump with respect to said dry box;

means to removably secure said automatic bailer in the vessel; and means carrying water pumped by said pump out of the vessel.

2. The automatic bailer of claim 1 wherein said pump includes a pump support bracket and said dry box includes a wall.

3. The automatic bailer of claim 2 wherein said flexible connection assembly joins said pump bracket to said dry box wall.

4. The automatic bailer of claim 3 wherein said flexible connection assembly includes a threaded bolt having a shank extending between said dry box wall and said pump bracket and further includes a resilient sleeve surrounding said bolt shank and interposed between said wall and said bracket.

5. The automatic bailer of claim 4 wherein said bolt is secured in said dry box wall by a jam nut, said pump bracket including a through bore, said bolt shank having a free end extending through said through bore.

6. The automatic bailer of claim 1 wherein said means to removably secure said bailer in the vessel includes hold down straps releasably engageable with said dry box, said hold down straps being connectable to the vessel.

7. The automatic bailer of claim 1 further including a carry strap.

8. The automatic bailer of claim 7 wherein said carry strap is a web strap attached to said dry box.

9. The automatic bailer of claim 1 further including a switch on said dry box, said switch providing said switched connection between said battery and said pump.

10. The automatic bailer of claim 1 further including a remotely positioned switch providing said switched connection between said battery and said pump.

* * * * *